US012467226B2

(12) United States Patent
Parzynski, Jr. et al.

(10) Patent No.: US 12,467,226 B2
(45) Date of Patent: Nov. 11, 2025

(54) ADAPTER BOARD HAVING A TOOL BIT ATTACHMENT PORTION

(71) Applicant: Caterpillar Inc., Peoria, IL (US)

(72) Inventors: David Bruno Parzynski, Jr., Peoria, IL (US); Thomas Marshall Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 714 days.

(21) Appl. No.: 17/729,449

(22) Filed: Apr. 26, 2022

(65) Prior Publication Data

US 2023/0340761 A1 Oct. 26, 2023

(51) Int. Cl.
*E02F 3/815* (2006.01)
*E02F 9/28* (2006.01)

(52) U.S. Cl.
CPC ..... *E02F 3/8152* (2013.01); *E02F 9/2816* (2013.01); *E02F 9/2825* (2013.01); *E02F 9/2833* (2013.01)

(58) Field of Classification Search
CPC ..... E02F 3/8152; E02F 9/2816
See application file for complete search history.

(56) References Cited

U.S. PATENT DOCUMENTS 4,883,129 A * 11/1989 Lonn ..... E21C 35/183 172/701.3
5,025,682 A * 6/1991 McCabe ..... F16B 21/186 74/606 R
5,370,448 A 12/1994 Sterwerf, Jr.
6,213,559 B1 * 4/2001 Stevens ..... E02F 3/8152 404/90
7,144,210 B2 12/2006 Massa et al.
10,047,503 B2 8/2018 LaHood et al.
11,396,739 B2 * 7/2022 Popp ..... E02F 9/2833
11,414,842 B2 * 8/2022 Bjerke ..... E02F 9/2841
11,459,736 B2 * 10/2022 Parzynski, Jr. ..... E02F 3/8152
11,697,923 B2 * 7/2023 Bjerke ..... E02F 9/2875 37/456
11,781,293 B2 * 10/2023 Bjerke ..... B23B 31/1077 37/455
2011/0204701 A1 8/2011 Monyak et al.
2018/0038065 A1 2/2018 Hunt
2020/0141092 A1 5/2020 Parzynski, Jr. et al.
2020/0141094 A1 5/2020 Parzynski, Jr. et al.
2023/0340753 A1 * 10/2023 Parzynski, Jr. ..... E02F 9/2883
2023/0340754 A1 * 10/2023 Parzynski, Jr. ..... E02F 9/2883
2023/0340760 A1 * 10/2023 Parzynski, Jr. ..... E02F 9/2841
2023/0340762 A1 * 10/2023 Parzynski, Jr. ..... E02F 9/2833

FOREIGN PATENT DOCUMENTS

DE 19611455 A1 9/1996
EP 2890870 5/2017
GB 2129853 A 5/1984
WO 2022010729 1/2022

* cited by examiner

*Primary Examiner* — Gary S Hartmann

(57) ABSTRACT

A tapered bushing includes a conical inner surface defining a conical axis, and a radial direction. The tapered bushing further includes an outer surface of revolution, and defines a minimum radial wall thickness that ranges from 3.0 mm to 15.0 mm measured from the conical inner surface to the outer surface of revolution. Also, the conical inner surface defines a draft angle that ranges from 2.0 degrees to 30.0 degrees.

14 Claims, 13 Drawing Sheets

ADAPTER BOARD HAVING A TOOL BIT ATTACHMENT PORTION

TECHNICAL FIELD

The present disclosure relates to blade assemblies with an adapter board having removable tool bits attached thereto. More specifically, the present disclosure relates to a blade assembly with a spring clip that is protected for retaining the bits, a tool bit with washout protection on its side surfaces, a void filler for helping avoid packing behind the spring arms of the spring clip, and/or a tapered bushing for bit removal.

BACKGROUND

Machines such as motor graders employ a long blade that is used to level work surfaces during the grading phase of a construction project or the like. These blades often encounter abrasive material such as rocks, dirt, etc. that can degrade the working edge, making such blades ineffective for their intended purpose. Some blades have a serrated cutting edge meaning that the edge is not continuously flat but undulates up and down, forming teeth. A drawback to such blades is that the teeth may be more easily worn than is desired. In harsh environments, such blades may be rendered dull, with the teeth having been essentially removed, after 100-200 hours of operation. Necessitating their replacement. Serrated cutting edges are sometimes provided to improve penetration via the use of detachable tool bits, etc.

Often, the tool bits that are attached to the adapter board of a blade assembly experience significant loads that may alter the shape of the tool bit and/or the adapter board to which the tool bit has been attached. Consequently, removing the tool bits may be difficult as a press fit or catch point is created by the deformation of the adapter board and/or the tool bit. This may necessitate pressing the tool bit out adapter board. This may be time consuming and/or may cause damage to the tool bit or adapter board.

In other situations, the bit shank hole or retaining mechanisms will experience packing of material scraped by the blade assembly and this will result in the bit getting seized within the bit shank hole. Some customers will try to strike the bits with a hammer but this results in the bits mushrooming within the bit shank hole and making it harder to remove them.

Also, features may be provided to help prevent rotation of the bit, but these features themselves may be subject to wear. Eventually, the bit may start rotating when the feature is worn too much to perform its intended function, necessitating maintenance.

In other cases, the sides of the tool bit may be subjected to washout on its side surfaces, especially if the tool bit is not facing directly in the direction of travel of the motor grader, necessitating maintenance.

In any of these scenarios, the adapter board, the tool bit, and/or retaining mechanism may need to be replaced, increasing the cost of using such blade assemblies.

Various solutions have been proposed for these scenarios. For example, US20190177954A1 discloses a flat rear surface of a tool bit that engages a corresponding flat surface of the adapter board, helping to prevent rotation. However, it also discloses using brazing or a similar process to hold the tool bit in place, making replacement of the tool bit time consuming.

U.S. Pat. No. 10,889,948 B2 discloses a plow blade edge system includes a plurality of wear bars mounted to a rear side of a plow blade section body. A first channel extends below each of the wear bars and is partially defined by the plow blade section body. Each wear bar includes a weldment of carbide matrix along a bottom edge of the wear bar forming a first wear surface. The weldment of carbide matrix is retained in the first channel. The plow blade section body further includes a second channel formed in and extending along a bottom edge of the plow blade section body. The second channel is operative to receive at least one carbide insert and forms a second wear surface. A total surface area of the first wear surface exposed to the road surface is greater than a total surface area of the second wear surface exposed to the road. However, it fails to teach anything about washout protection for the size of the tool bit.

Looking at U.S. Pat. No. 11,035,103 B2 discloses a lock for a ground engaging tool may have a first diameter body portion, a neck portion extending from the body portion along a rotational axis of the lock and having a second diameter smaller than the first diameter, and a head portion extending from the neck portion along the rotational axis. The head portion may have first and second generally planar end surfaces extending from a bottom surface to a top surface, and first and second cam surfaces, which connect the end surfaces and each include a convex portion and a concave portion. But, it fails to disclose moving parts of the lock or voids that may be packed with material, interfering with the function of the lock. Therefore, it fails to address the problem of packing the lock.

Finally, U.S. Pat. No. 10,047,403 discloses various exemplary embodiments of a retainer system for a ground engaging tool. In one exemplary embodiment, the retainer system may include a lock having a lock rotation axis and including an outer surface extending about the lock rotation axis. The retainer system may also include a retainer bushing including an inner surface extending about the lock rotation axis, where the inner surface is configured to rotatably receive the outer surface of the lock. The outer surface of the lock and the inner surface of the retainer bushing may be aligned substantially parallel to the lock rotation axis. This patent does not deal with shanks of tool bits that are used to retain the tool bits to a moldboard of a motor grader or the like. Thus, the problem of packing between the shank and the cylindrical hole of the moldboard is not addressed.

Accordingly, there exists a need for developing solutions for the aforementioned scenarios including packing, and wear or washout, etc.

SUMMARY OF THE DISCLOSURE

A tapered bushing according to an embodiment of the present disclosure may include a conical inner surface defining a conical axis, and a radial direction. The tapered bushing may further include an outer surface of revolution, and may define a minimum radial wall thickness that ranges from 3.0 mm to 15.0 mm measured from the conical inner surface to the outer surface of revolution. Also, the conical inner surface may define a draft angle that ranges from 2.0 degrees to 30.0 degrees.

An adapter board according to an embodiment of the present disclosure may comprise an upper moldboard interfacing portion include a rear surface, a front surface, and a series of thru-apertures extending from the front surface to the rear surface, as well as a lower tool bit attachment portion, terminating in a lower adapter board free end with a bottom surface, and including a top surface disposed adjacent the rear surface of the upper moldboard interfacing portion. The top surface and bottom surface may define a series of thru-holes extending from the top surface to the bottom surface, each thru-hole of the series of thru-holes being in communication with each of the series of thru-apertures. Also, the adapter board may define a lateral direction, a vertical direction that is perpendicular to the lateral direction, and a horizontal direction that is perpendicular to the vertical direction, and the lateral direction. Each of the series of thru-holes defines a thru-hole diameter, the lower tool bit attachment portion defines a lower horizontal thickness, and each thru-hole of the series of thru-holes may be disposed horizontally partially underneath the upper moldboard interfacing portion and/or a ratio of the lower horizontal thickness to the thru-hole diameter may range from 1.25 to 1.75.

DETAILED DESCRIPTION

Figure 1:
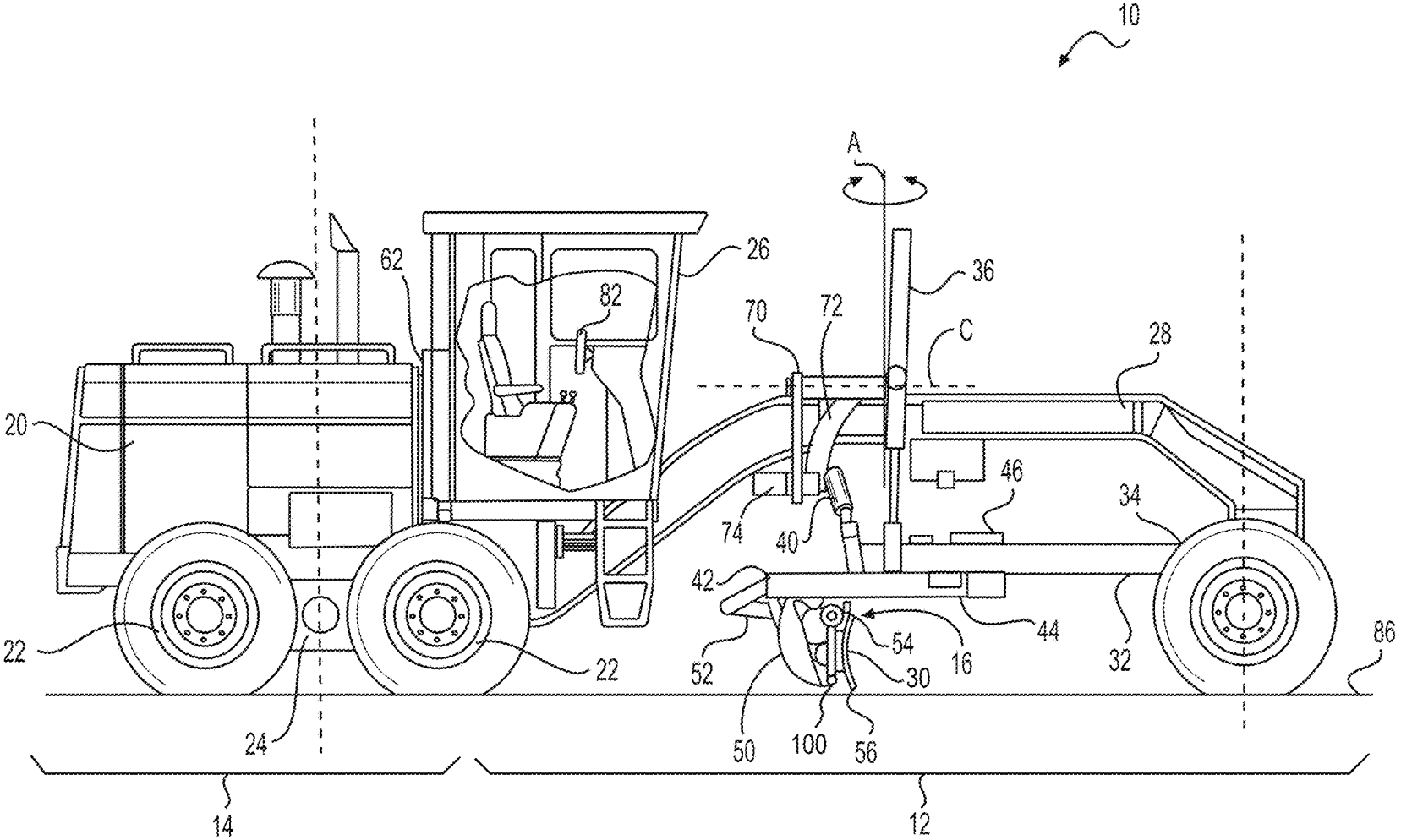
FIG. 1 is a side view of a motor grader that may employ a blade assembly, a spring clip, a tapered bushing, and/or a tool bit according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments that provide desired performances for a blade assembly including those that provide wear and packing prevention for the retaining mechanism used to attached a tool bit to a blade assembly, those that have a protected anti-rotation feature, and those that provide washout protection for a tool bit will be discussed.

First, a machine will now be described to give the reader the proper context for understanding how various embodiments of the present disclosure are used to level, grade or rip up a work surface. It is to be understood that this description is given as exemplary and not in any limiting sense. Any embodiment of an apparatus or method described herein may be used in conjunction with any suitable machine.

FIG. 1 is a side view of a motor grader in accordance with one embodiment of the present disclosure. The motor grader 10 includes a front frame 12, rear frame 14, and a work implement 16, e.g., a blade assembly 18, also referred to as a drawbar-circle-moldboard assembly (DCM). The rear frame 14 includes a power source (not shown), contained within a rear compartment 20, that is operatively coupled through a transmission (not shown) to rear traction devices or wheels 22 for primary machine propulsion.

As shown, the rear wheels 22 are operatively supported on tandems 24 which are pivotally connected to the machine between the rear wheels 22 on each side of the motor grader 10. The power source may be, for example, a diesel engine, a gasoline engine, a natural gas engine, or any other engine known in the art. The power source may also be an electric motor linked to a fuel cell, capacitive storage device, battery, or another source of power known in the art. The transmission may be a mechanical transmission, a hydraulic transmission, or any other transmission type known in the art. The transmission may be operable to produce multiple output speed ratios (or a continuously variable speed ratio) between the power source and driven traction devices.

The front frame 12 supports an operator station 26 that contains operator controls 82, along with a variety of displays or indicators used to convey information to the operator, for primary operation of the motor grader 10. The front frame 12 also includes a beam 28 that supports the blade assembly 100 and which is employed to move the blade assembly 100 to a wide range of positions relative to the motor grader 10. The blade assembly 100 is manipulated by a drawbar 32 pivotally mounted to a first end 34 of the beam 28 via a ball joint (not shown). The position of the drawbar 32 is controlled by three hydraulic cylinders: a right lift cylinder 36 and a left lift cylinder (not shown) that control vertical movement, and a center shift cylinder 40 that controls horizontal movement. The right and left lift cylinders are connected to a coupling 70 that includes lift arms 72 pivotally connected to the beam 28 for rotation about axis C. A bottom portion of the coupling 70 has an adjustable length horizontal member 74 that is connected to the center shift cylinder 40.

The drawbar 32 includes a large, flat plate, commonly referred to as a yoke plate 42. Beneath the yoke plate 42 is a circular gear arrangement and mount, commonly referred to as the circle 44. The circle 44 is rotated by, for example, a hydraulic motor referred to as the circle drive 46. Rotation of the circle 44 by the circle drive 46 rotates the attached blade assembly 100 about an axis A perpendicular to a plane of the drawbar yoke plate 42. The blade cutting angle is defined as the angle of the blade assembly 100 relative to a longitudinal axis of the front frame 12. For example, at a zero degree blade cutting angle, the blade assembly 100 is aligned at a right angle to the longitudinal axis of the front frame 12 and beam 28.

The blade assembly 100 is also mounted to the circle 44 via a pivot assembly 50 that allows for tilting of the blade assembly 100 relative to the circle 44. A blade tip cylinder 52 is used to tilt the blade assembly 100 forward or rearward. In other words, the blade tip cylinder 52 is used to tip or tilt a top edge 54 relative to the bottom cutting edge 56 of the blade 30, which is commonly referred to as blade tip. The blade assembly 100 is also mounted to a sliding joint associated with the circle 44 that allows the blade assembly 100 to be slid or shifted from side-to-side relative to the circle 44. The side-to-side shift is commonly referred to as blade side shift. A side shift cylinder (not shown) is used to control the blade side shift. The placement of the blade assembly 100 allows a work surface 86 such as soil, dirt, rocks, etc. to be leveled, graded or tipped up as desired. The motor grader 10 includes an articulation joint 62 that pivotally connects front frame 12 and rear frame 14, allowing for complex movement of the motor grader, and the blade.

U.S. Pat. No. 8,490,711 to Polumati illustrates another motor grader with fewer axes of movement than that just described with respect to FIG. 1. It is contemplated that such a motor grader could also employ a blade assembly according to various embodiments of the present disclosure, etc. Other machines than graders may use various embodiments of the present disclosure as well.

Figure 2:
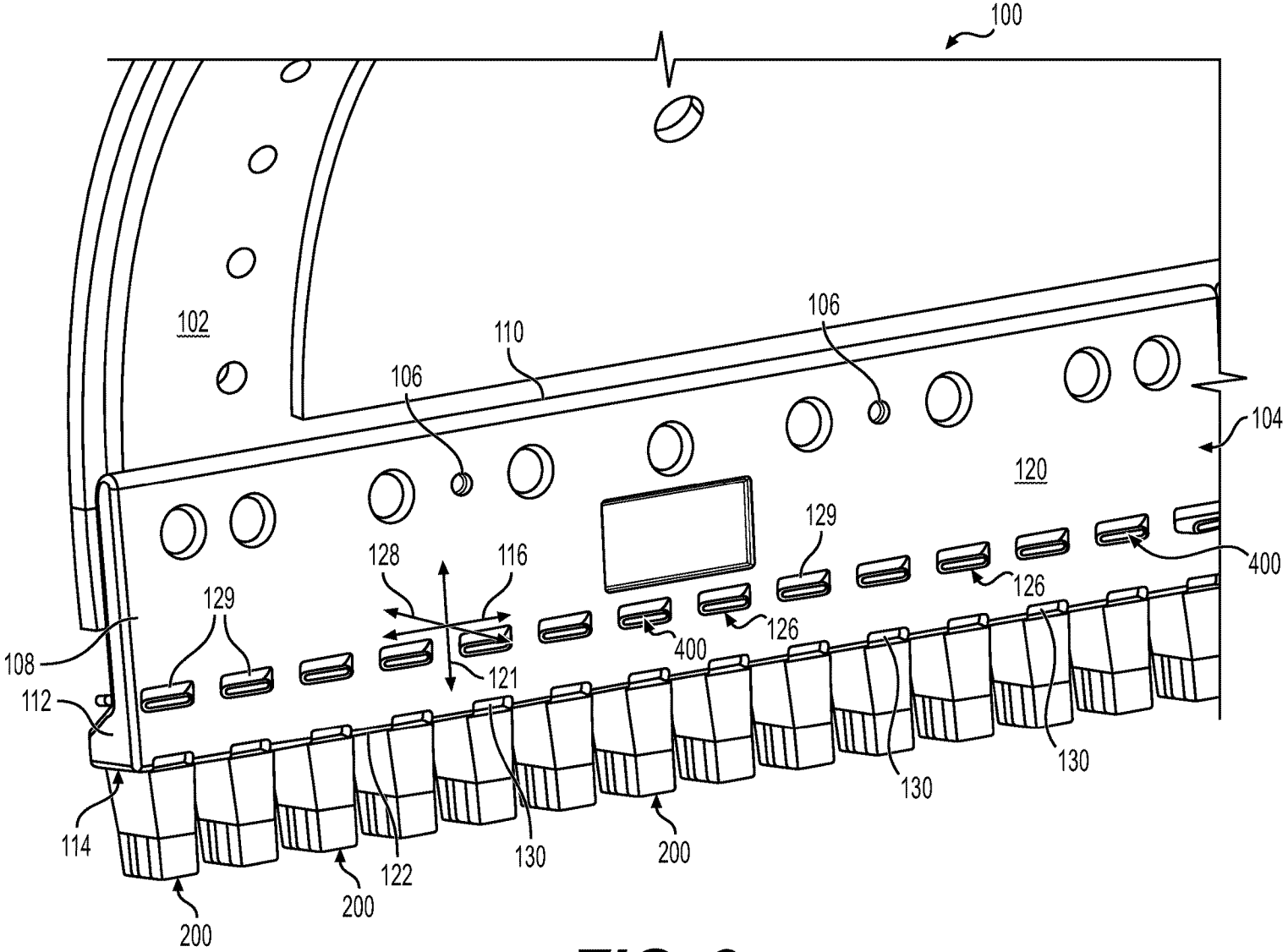
FIG. 2 is a front oriented perspective view of a blade assembly according to an embodiment of the present disclosure constructed similarly or identically to that of FIG. 1.

Turning now to FIG. 2, a blade assembly 100 for use with a grading machine 10 according to an embodiment of the present disclosure will be described. The blade assembly 100 comprises a moldboard 102, and an adapter board 104 that may be fastened together using fastener apertures 106. The adapter board may include an upper moldboard interfacing portion 108, terminating in an upper adapter board free end 110. The adapter board 100 further comprises a lower tool bit attachment portion 112, terminating in a lower adapter board free end 114. The lower tool bit attachment portion 112 defines a length along the lateral direction 116. A plurality of tool bits 200 are provided that are configured to be attached to the adapter board 102. While FIG. 2 shows the tool bits 200 already attached to the adapter board 104 via mounting hardware (not shown), it is to be understood that the tool bits 200 may be supplied with the adapter board 102 or separately from the adapter board 102, without being attached to the adapter board 102.

Various features for protecting the retaining mechanism used to attached to tool bits will be described with reference to FIGS. 2 thru 5. The upper moldboard interfacing portion 108 of the adapter board may include a rear flat surface 118 (may not be flat in other embodiments of the present disclosure), and a front surface 120, while the lower tool bit attachment portion 112 terminates vertically (see vertical direction 121) at the lower adapter board free end 114, defining a bottom surface 122. This bottom surface 122 at least partially defines a plurality of shank receiving bores 124 (see FIG. 5), and may include a plurality of bushings 300 that are individually disposed in a corresponding one of the plurality of shank receiving bores.

Figure 6:
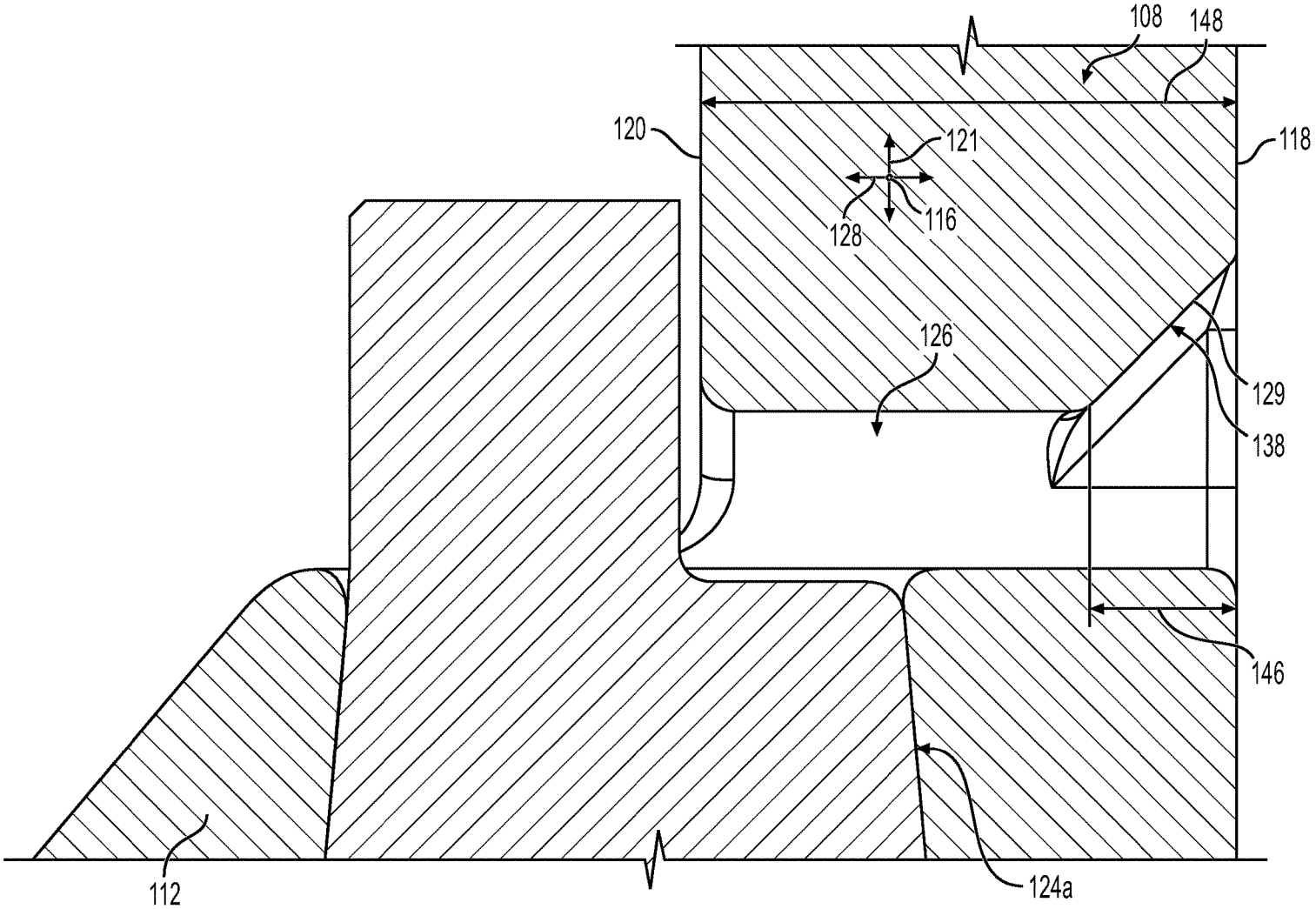
FIG. 6 is an enlarged view showing an embodiment similar to that of FIG. 5 with the spring removed, and lacking a tapered bushing according to an embodiment of the present disclosure.

In other embodiments, the bushings may be omitted such that the shank of a tool bit is received directly into the shank receiving bore 124*a* such as shown in FIG. 6. It is to be understood that the blade assembly may be provided or obtained in various stages of assembly, ranging from fully assembled to completely unassembled and in-between these stages.

Figure 5:
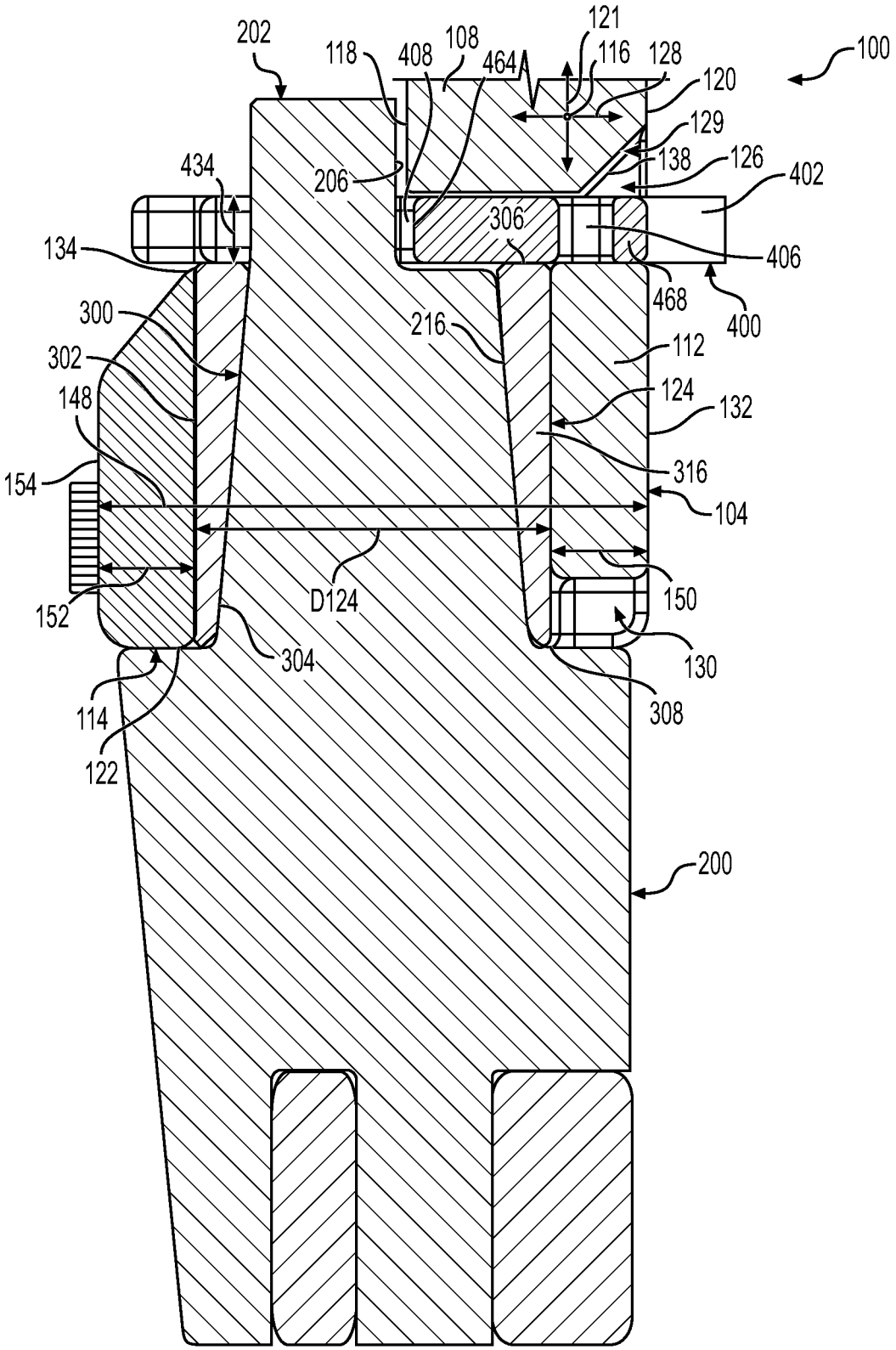
FIG. 5 is a partial side sectional view of the blade assembly of FIG. 3 taken along lines 5-5 thereof, showing the use of the spring clip and a tapered bushing for retaining and removing the tool bit.

As best understood with reference to FIGS. 2 and 5, the upper moldboard interfacing portion 108 may include a series of retaining spring clip receiving apertures 126 extending horizontally (see horizontal direction 128) from the front surface 120 to the rear flat surface 118. Each one of the plurality of shank receiving bores 124, 124*a* may be in communication with each one of the plurality of retaining spring clip receiving apertures 126 (i.e., a path exists between the bores and the apertures that does not extend to the exterior of the adapter board). As shown in FIG. 5, each one of the plurality of shank receiving bores 124 may include a cylindrical configuration. In other embodiments such as shown in FIG. 6, the shape of the bore 124*a* may be conical, etc.

As depicted in FIGS. 2, 3, 5, and 6, each one of the plurality of spring clip receiving apertures 126 may include a lead-in surface 129 extending from the front surface 120 toward the rear flat surface 118. This feature may allow a tool such a pry bar or the like to enter the aperture, and engage the handle 402 of the retaining spring clip 400 for extraction.

Figure 3:
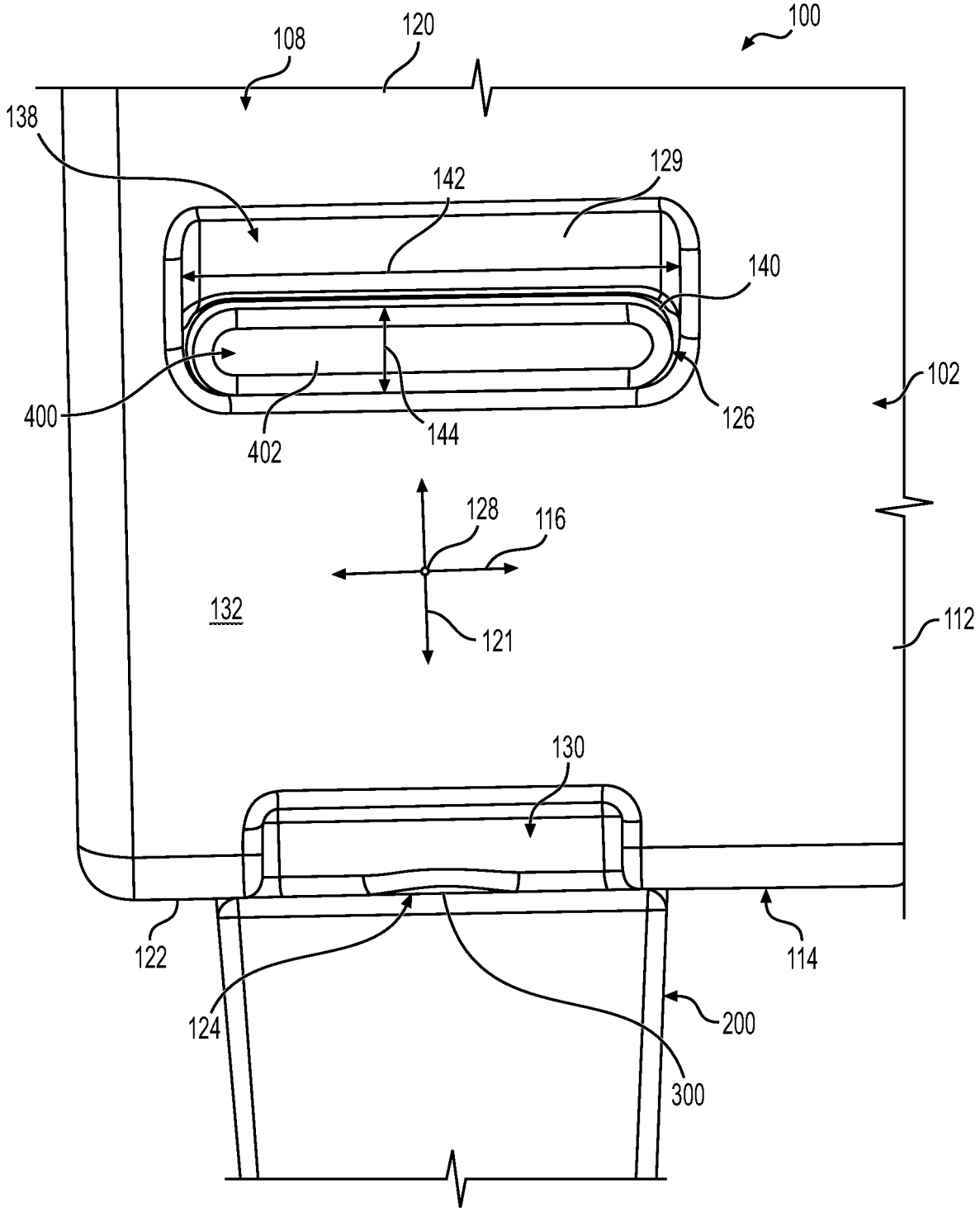
FIG. 3 is enlarged front view of an instance of a tool bit and retaining spring clip of the blade assembly of FIG. 2.

Similarly in FIGS. 2, 3, and 5, the bottom surface 122 of the lower tool bit attachment portion 112 may include a plurality of pry slots 130 disposed vertically underneath the plurality of spring clip receiving apertures 126. This may not be the case for other embodiments of the present disclosure. For example, the slots may be disposed near the rear of the adapter board, etc.

In certain embodiments as shown in FIG. 5, the lower tool bit attachment portion 112 may also include a forward surface 132, and the plurality of pry slots 130 may extend horizontally or forwardly through the forward surface 132. This allows a pry bar or other tool to be inserted to extract the tool bit.

As best seen in FIG. 5, the forward surface 132 of the lower tool bit attachment portion 112 is coplanar with the front surface 120 of the upper moldboard interfacing portion 108. This may not be the case in other embodiments of the present disclosure.

Figure 4:
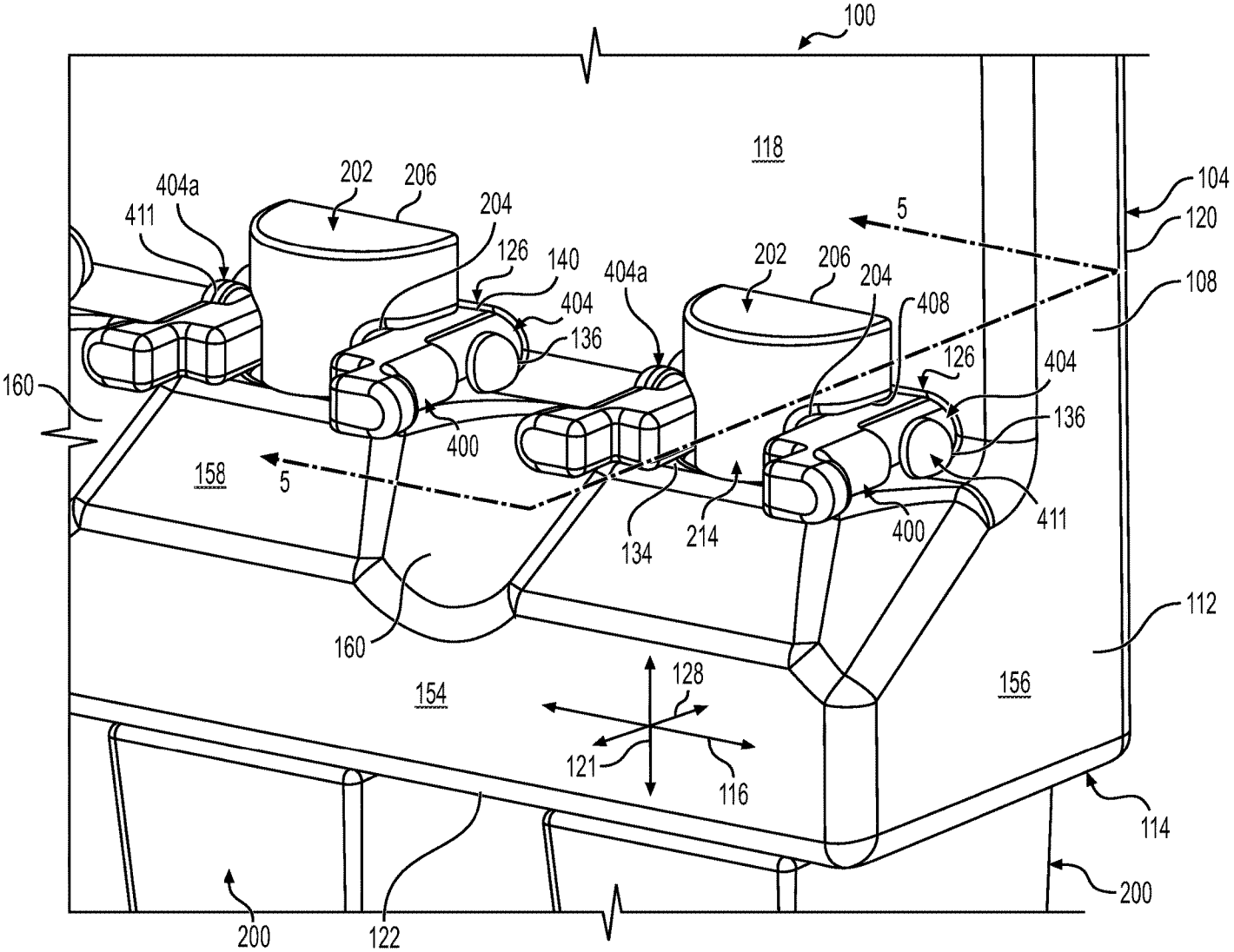
FIG. 4 is an enlarged rear view of a portion of the blade assembly of FIG. 2, showing a spring clip for retaining the tool bit according to an embodiment of the present disclosure.

Looking at FIGS. 2, 4 and 5, a plurality of retaining spring clips 400 may be inserted into the plurality of retaining spring clip receiving apertures 126. Also, a plurality of tool bits 200 may be provided that include a shank 202 with a spring clip receiving slot 204, and a flat 206 that is configured to engage the rear flat surface 118 of the upper moldboard interfacing portion 108. This feature helps to prevent rotation of the tool bit relative to the adapter board.

Looking at FIGS. 2 and 4 together, each of the plurality of retaining spring clips 400 may comprise at least one spring arm 404 that is disposed completely horizontally or rearwardly of the front surface 120 of the upper moldboard interfacing portion 108. This may help prevent wear to the working part of the spring clip, prolonging its useful life.

Focusing now at FIGS. 4 and 5, the lower tool bit attachment portion 112 may include a top shelf surface 134, and the at least one spring arm 404 extends rearwardly past the upper moldboard interfacing portion 108 (e.g., its rear flat surface 118) onto the top shelf surface 134, while a U-shaped portion 408 slides into the spring clip receiving slot 204 of the shank 202 of the tool bit 200. Now, the tool bit 200 is locked into place since the spring arms 404, 404*a* of the retaining spring clip 400 prevent its removal because of the catch points 136 created between the arms and the rear flat surface of the upper moldboard interfacing portion, while the U-shaped portion prevents any vertical movement of the tool bit since it's in the slot of the shank.

A tool bit 200*a* according to an embodiment of the present disclosure that may have the aforementioned anti-rotation performance will now be described with reference to FIGS. 11 and 12. It is to be understood that tool bit 200 as shown in FIGS. 2 thru 5 may be similarly or identically configured as the tool bit 200*a* shown in FIGS. 11 and 12 except for the omission of washout protection on the sides of its working portion, which will be discussed in detail later herein.

The tool bit 200*a* may include a working portion 208, and a shank 202 defining a shank free end 210, including a T-slot (e.g., spring clip receiving slot 204, 204*a*) spaced away from the shank free end 210, and a surface of non-revolution (e.g., a flat 206, or other surface of non-revolution such as a non-cylindrical or non-conical surface, etc.) that extends from the slot. Put another way, a T-stem is formed by slots 204, 204*a*.

In some embodiments, the shank 202 may include a partially cylindrical portion 214 extending from the shank free end 210, and the slot (e.g., see 204, 204*a*) may extend through the partially cylindrical portion 214. Also, the flat 206 may extend perpendicularly to the slot(s). In addition, the shank 202 may include a conical portion 216 that extends axially (e.g., along a central axis 218) from the partially cylindrical portion 214 toward the working portion 208. It should be noted that the central axis may be a cylindrical axis, a conical axis or both as shown, but not necessarily so. For example, the cylindrical and conical portions may be differently configured or may be offset from each other so that they do not share the same central axis, etc.

Figure 12:
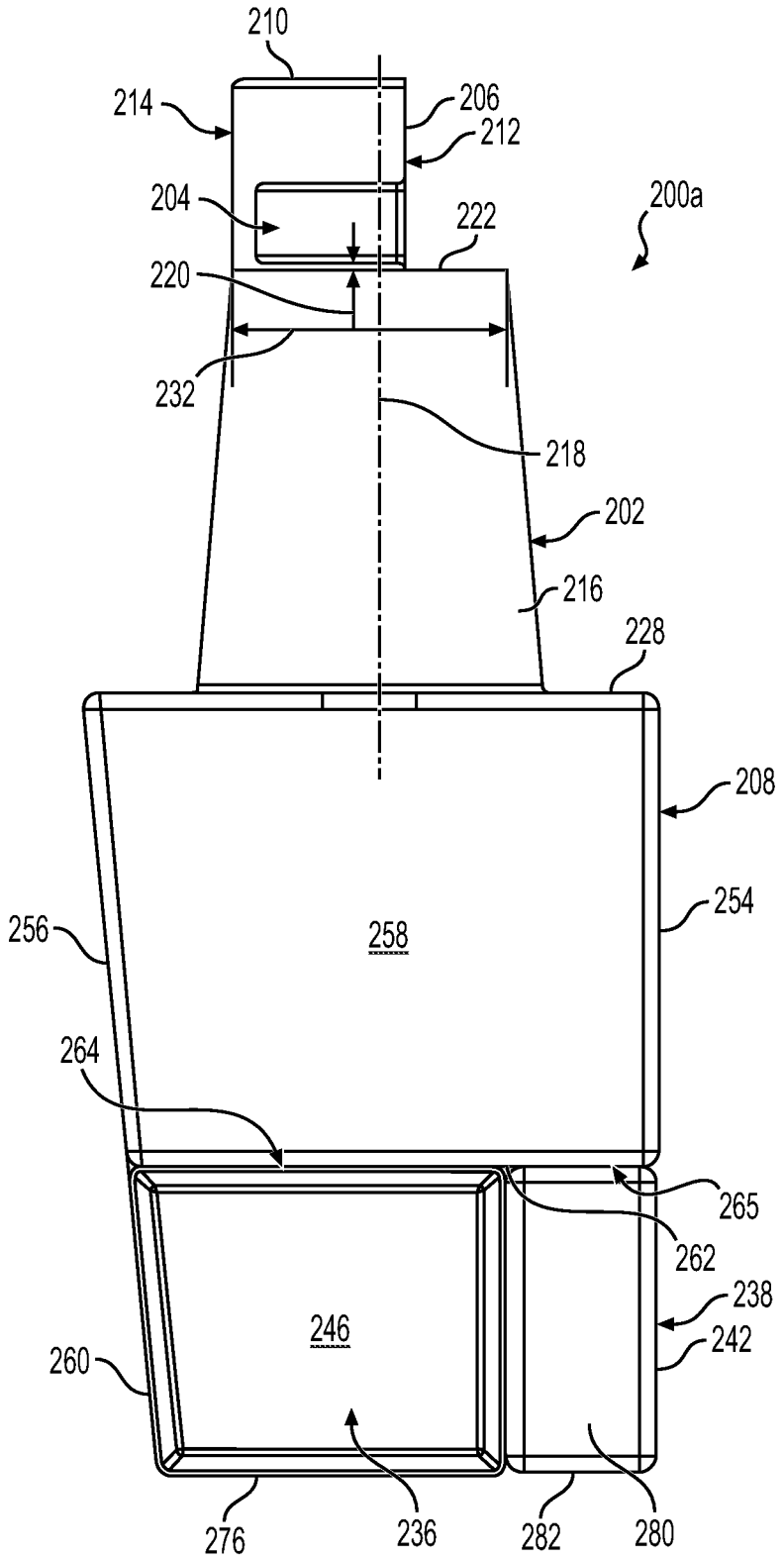
FIG. 12 is a side view of the tool bit of FIG. 11.

Moreover, the slot (e.g., see 204) may be spaced axially away from conical portion 216 a first predetermined distance 220 (see FIG. 12). A planar surface 222 may be perpendicular to the flat 206, forming a top extremity of the conical portion 216. Other configurations of the shank are possible in other embodiments of the present disclosure.

Figure 11:
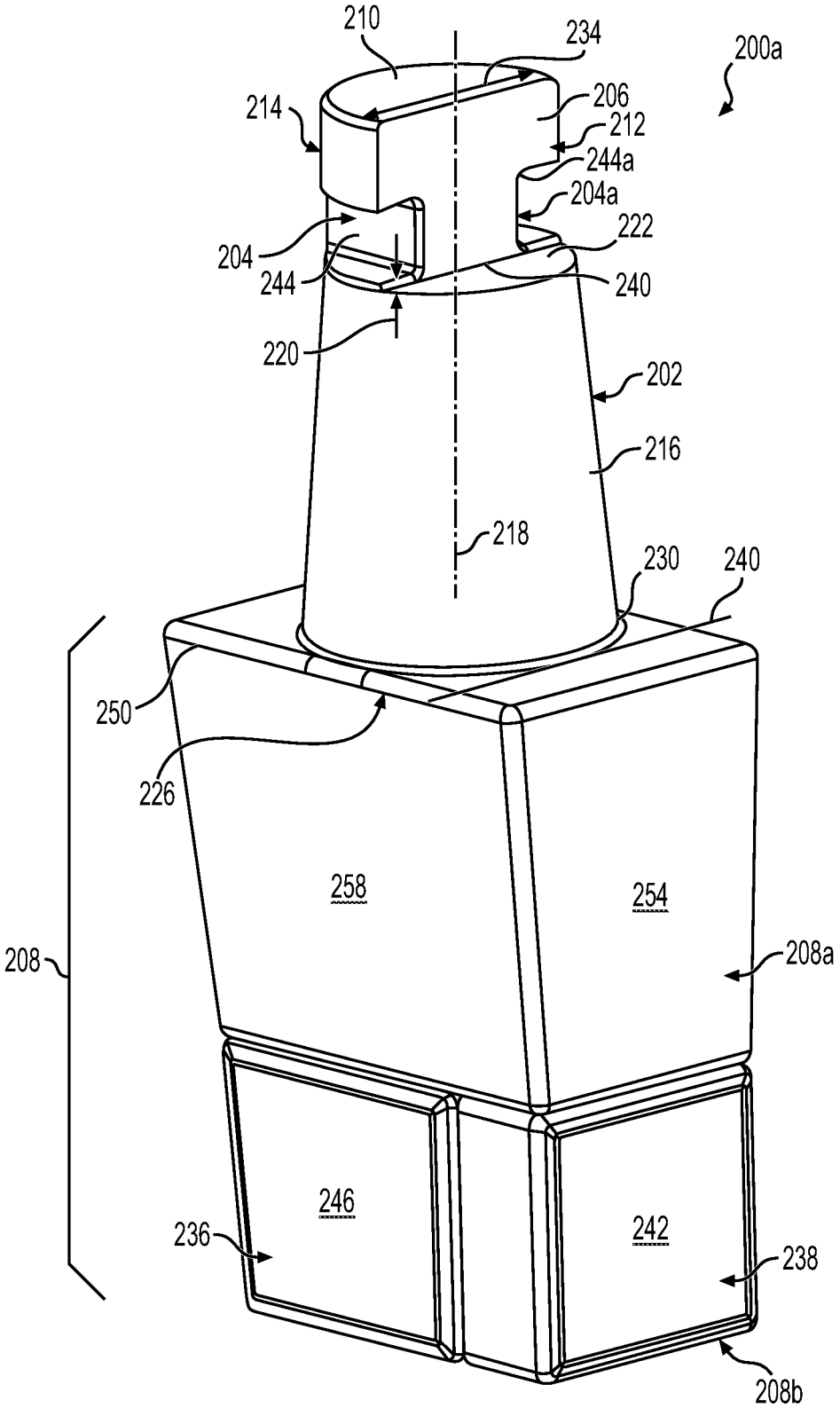
FIG. 11 is a perspective view of a tool bit that may be used with any of the above embodiments that is configured with washout protection on its sides.
Figure 13:
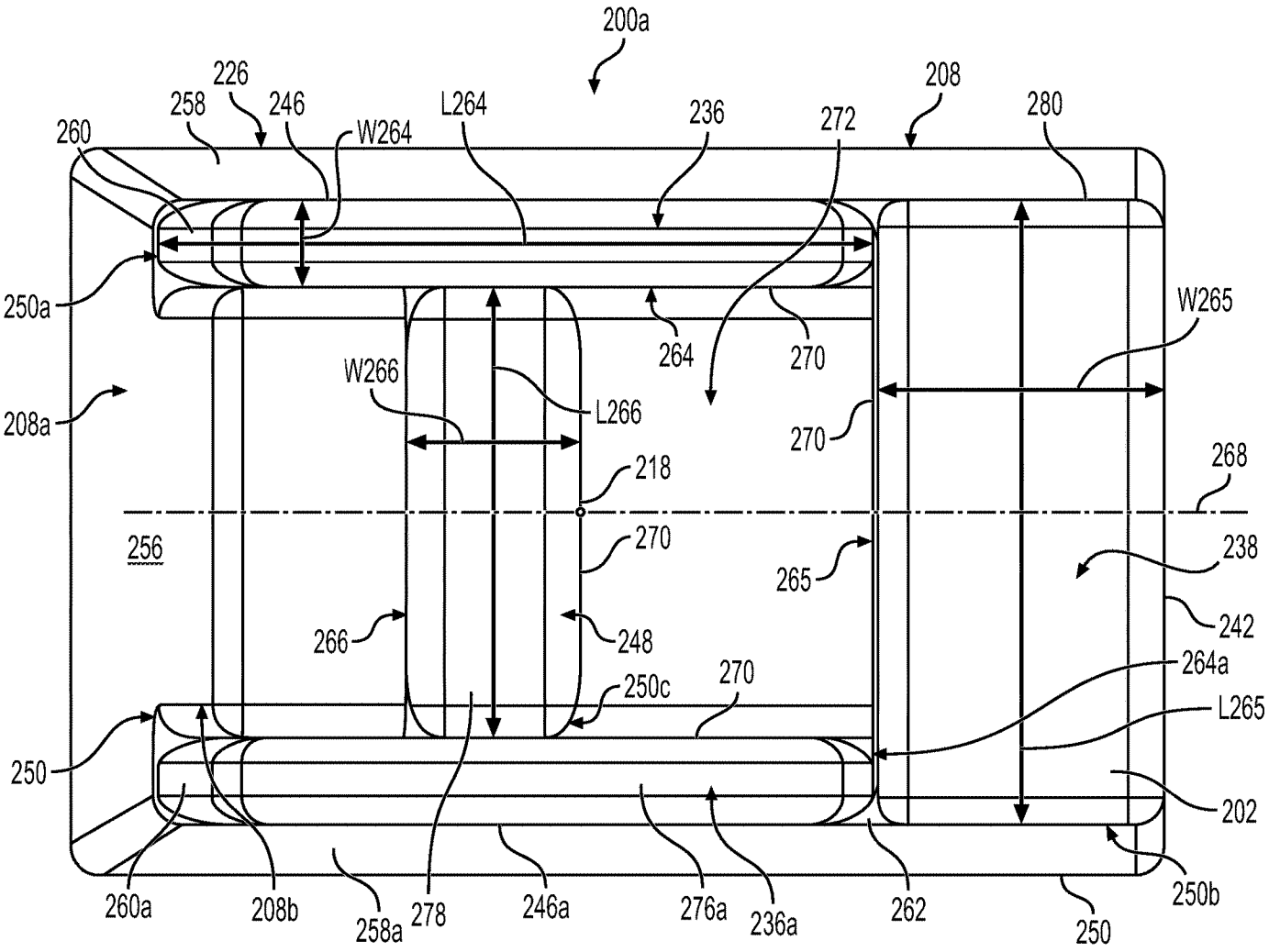
FIG. 13 is a bottom view of the tool bit of FIG. 11.

As best seen in FIGS. 11 and 13, the working portion 208 may define a working portion perimeter 226 in a plane 230 that is perpendicular to the central axis 218. Similarly as seen in FIG. 1, the conical portion 216 defines a circular perimeter 228 in a parallel plane, and the working portion perimeter 226 may surround the circular perimeter 228 when projected onto either plane along the central axis 218. This may not be the case in other embodiments of the present disclosure.

Referring now to FIGS. 11 and 12, the conical portion 216 of the shank 202 defines a conical portion minimum diameter 232, and the partially cylindrical portion 214 of the shank 202 defines a cylindrical diameter 234 that is the same as the conical portion minimum diameter 232 (e.g., within 0.5 mm). This may not be the case in other embodiments of the present disclosure.

The adapter board 104 may be provided as replacement part or retrofit in the field, and may be configured as previously described herein. As best seen in FIGS. 2 and 3, each one of the series of retaining spring clip receiving apertures 126 may define a perimeter 140 having an elongated racetrack shape (so called since it has two straight parallel sides that are joined by semicircles). This shape may match that of the exterior surface of the retaining spring clip to allow it to pass through the aperture with a little clearance, helping to prevent the ingress of material into the aperture in use. Other shapes are possible in other embodiments of the present disclosure.

In other embodiments of the blade assembly, an adapter board may be used that provides packing prevention for the spring clip used to hold the tool bit onto the adapter board. For example as seen in FIGS. 3 and 5, the adapter board 104 may include an upper moldboard interfacing portion 108 including a rear surface (e.g., may be a rear flat surface 118, or another surface of non-revolution), a front surface 120, and a series of thru-apertures (e.g., retaining spring clip receiving slots 126) extending from the front surface 120 to the rear surface. Each aperture of the series of thru-apertures may include a top ramped portion 138 (e.g., may form the lead-in surface 129) that extends from the front surface 120, and terminates short of the rear surface (see rear flat surface 118) as best seen in FIG. 5.

In other embodiments, the ramped portion may be a bottom ramped portion instead of a top ramped portion 138. As seen in FIGS. 2 and 5, the adapter board 104 may define a lateral direction 116, a vertical direction 121 that is perpendicular to the lateral direction 116, and a horizontal direction 128 that is perpendicular to the vertical direction 121, and the lateral direction 116. In FIG. 6, the ramped portion 138 extends a ramped portion horizontal distance 146, while the upper moldboard interfacing portion 108 defines a horizontal thickness 148. A ratio of the horizontal thickness 148 to the ramped portion horizontal distance 146 ranges from 2.0 to 4.0 in some embodiments of the present disclosure. This arrangement may allow the ramp to be aligned with a handle slot of the retaining spring clip as will be described in more detail later herein.

Looking at FIGS. 4 and 5, the adapter board 104 may also have a lower tool bit attachment portion 112, terminating in a lower adapter board free end 114 with a bottom surface 122, while also including a top surface (e.g., may take the form of the top shelf surface 134) disposed adjacent the rear surface of the upper moldboard interfacing portion 108. The lower tool bit attachment portion 112 may also define a series of thru-holes (e.g., may take the form of shank receiving bores 124, 124*a*) extending from the top surface (see 134) to the bottom surface 122. As best seen in FIGS. 5 and 6, each thru-hole of the series of thru-holes (e.g., see 124, 124*a*) is in communication with each of the series of thru-apertures (e.g., see 126). This may not be the case for other embodiments of the present disclosure. A plurality of bushings 300 may also be provided with one of the plurality of bushings being situated in one of the series of thru-holes (see FIG. 5). This may not be the case for other embodiments such as shown in FIG. 6 where no bushing is employed.

Looking at FIGS. 2 and 3, it can be seen that each of the series of thru-apertures (e.g., see 126) forms a perimeter 140 on the rear surface (or on the front surface 120) wherein a length of the aperture 142 is greater than a height 144 of the aperture 142.

A plurality of retaining spring clips 400, 400*a* may also be provided with each one of the plurality of retaining spring clips being disposed in each one of the series of thru-apertures (e.g., see 126). As understood with reference to FIG. 5, each one of the plurality of retaining spring clips 400, 400*a* may include a handle portion (or handle 402, also see FIGS. 8 thru 10) with a handle slot 406 that is disposed underneath the top ramped portion 138.

Figure 8:
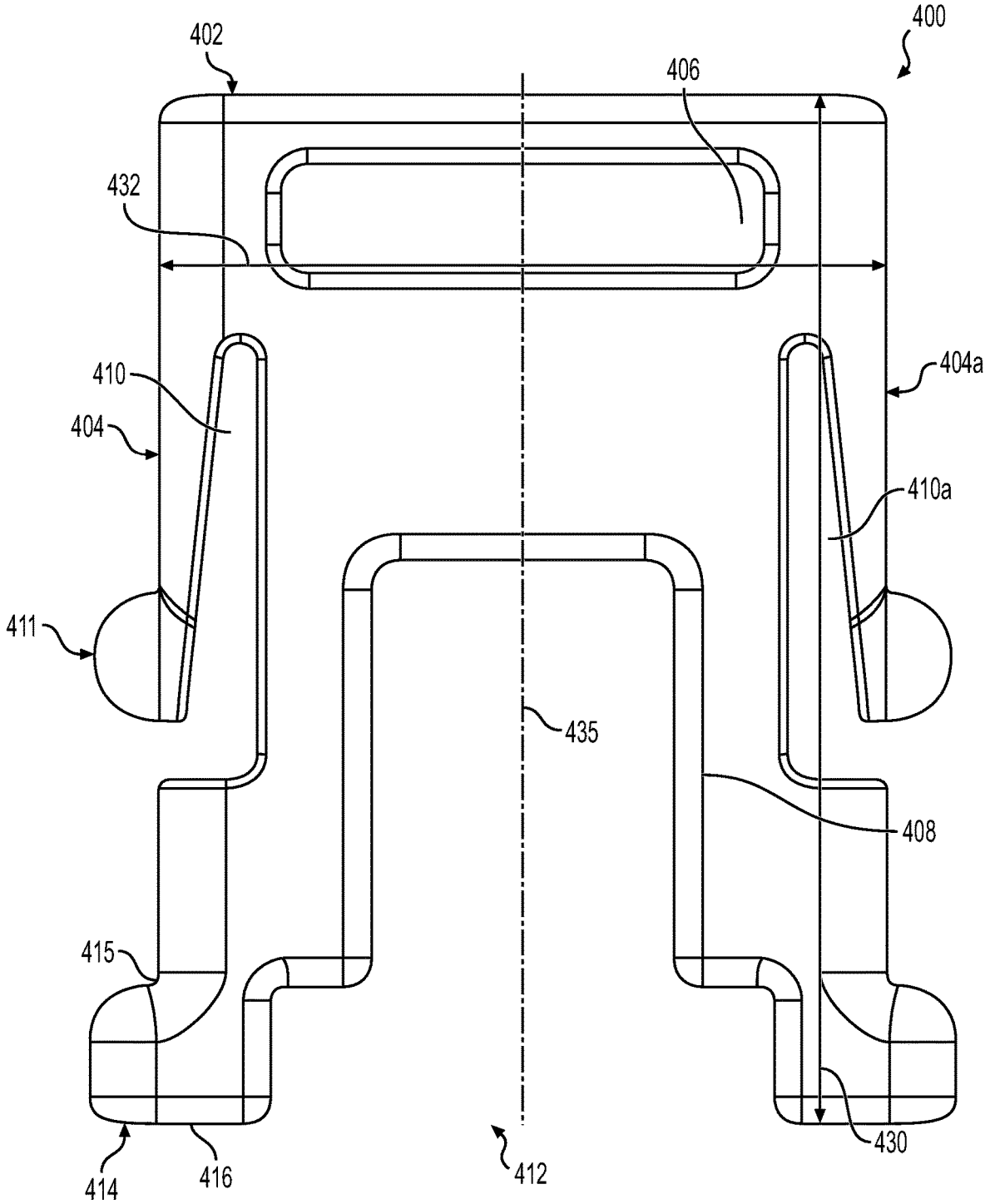
FIG. 8 is a top view of the spring clip of FIG. 4 shown in isolation.
Figure 9:
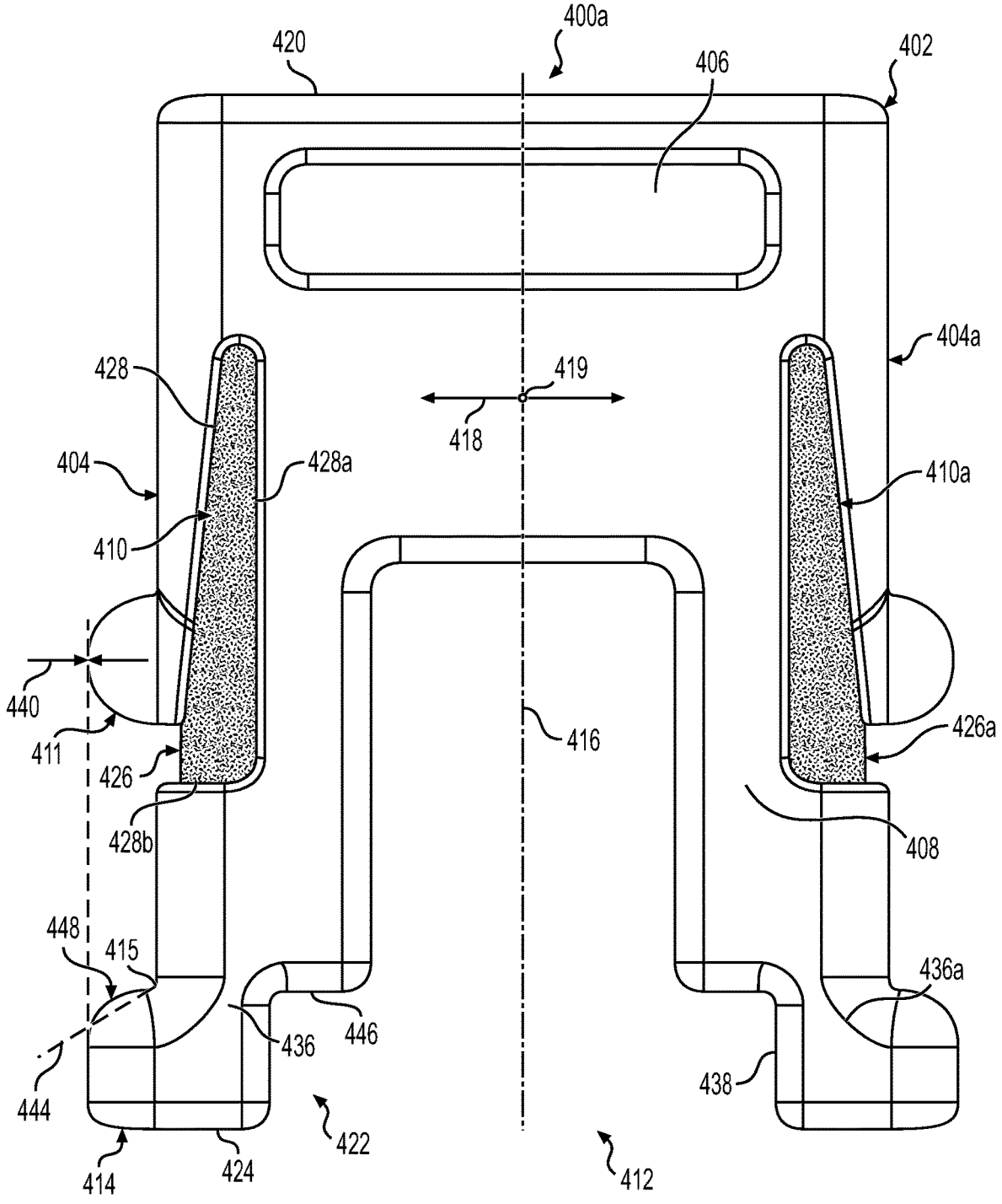
FIG. 9 is a top view of spring clip similarly or identically configured to that of FIG. 8 except that a void filler is employed to help prevent material packing behind the spring arms.

Referring to FIGS. 8 and 9, each one of the plurality of retaining spring clips 400, 400*a* includes at least a first adapter board engaging spring arm 404, 404*a* that is defined by a void 410, 410*a*, and a void filler 412, 412*a* may be disposed behind the at least first adapter board engaging spring arm 404*a* in the void 410, 410*a*.

As understood by looking at FIGS. 4 and 5, the at least first adapter engaging spring arm 404, 404*a* may be disposed mostly (i.e., greater than 50% of its length along the horizontal direction) in one of the series of thru-apertures 126, 126*a*.

The at least first adapter engaging spring 404, 404*a* may include a ball portion 411 that is not disposed in one of the series of thru-apertures 126, 126*a*, but is disposed adjacent the rear surface (e.g., rear flat surface 118) of the upper moldboard interfacing portion 108. Also, each one of the plurality of retaining spring clips 400, 400*a* includes a central slot 412 (see FIGS. 8 and 9) that is configured to mate with one or more side slots (e.g., see 204, 204*a* in FIG. 4) of a plurality of tool bits 200 having shanks 202 that fit within the central slot 412. As shown in FIGS. 8 and 9, the plurality of retaining spring clips 400, 400*a* may include a stop portion 414 (and/or a cam portion if a lead-in is provided at the free end) defining a spring clip free end 416. The stop is formed by the right angle (or nearly so) formed that the stop surface 415 makes with the direction of travel of the spring clip in use.

More particularly as understood by looking at FIGS. 4 and 9 together, the stop portion 414 may form an enlarged release slot 438 extending from the tool bit receiving slot (e.g., see the central slot 412) in a direction that is perpendicular to the axis of movement (may be parallel or even coincident with the longitudinal direction 416) a predetermined distance 440 past a dual action cam surface 442 (so called since this surface causes the spring arm to be depressed regardless if the spring moves rearwardly or forwardly along the axis of movement) along a direction that is perpendicular to the axis movement (e.g., see lateral direction 418).

Looking closely at FIG. 9, the stop surface 415 extends along a tangent 444 that is oblique to axis of movement (or longitudinal direction 416), and that is adjacent (i.e., +/−2.0 mm) to a slot end surface 446 of the enlarged release slot 438 along the axis of movement. More specifically, the stop surface 415 is part of a inflecting arcuate surface 448 (so called since this surface transitions from a concave arcuate surface to a convex arcuate surface) that at least partially matches a corresponding feature located at the entry to the retaining spring clip receiving aperture 126. Other configurations for these features are possible in other embodiments of the present disclosure.

Any retaining spring clip disclosed herein may comprise at least one of the following materials: an iron, a stainless steel, and a spring steel. If the configuration and/or material of the retaining spring clip provide enough resiliency, then this cam portion may allow the U-shaped portion 408 to deform when passing through the adapter board from the front.

Figure 10:
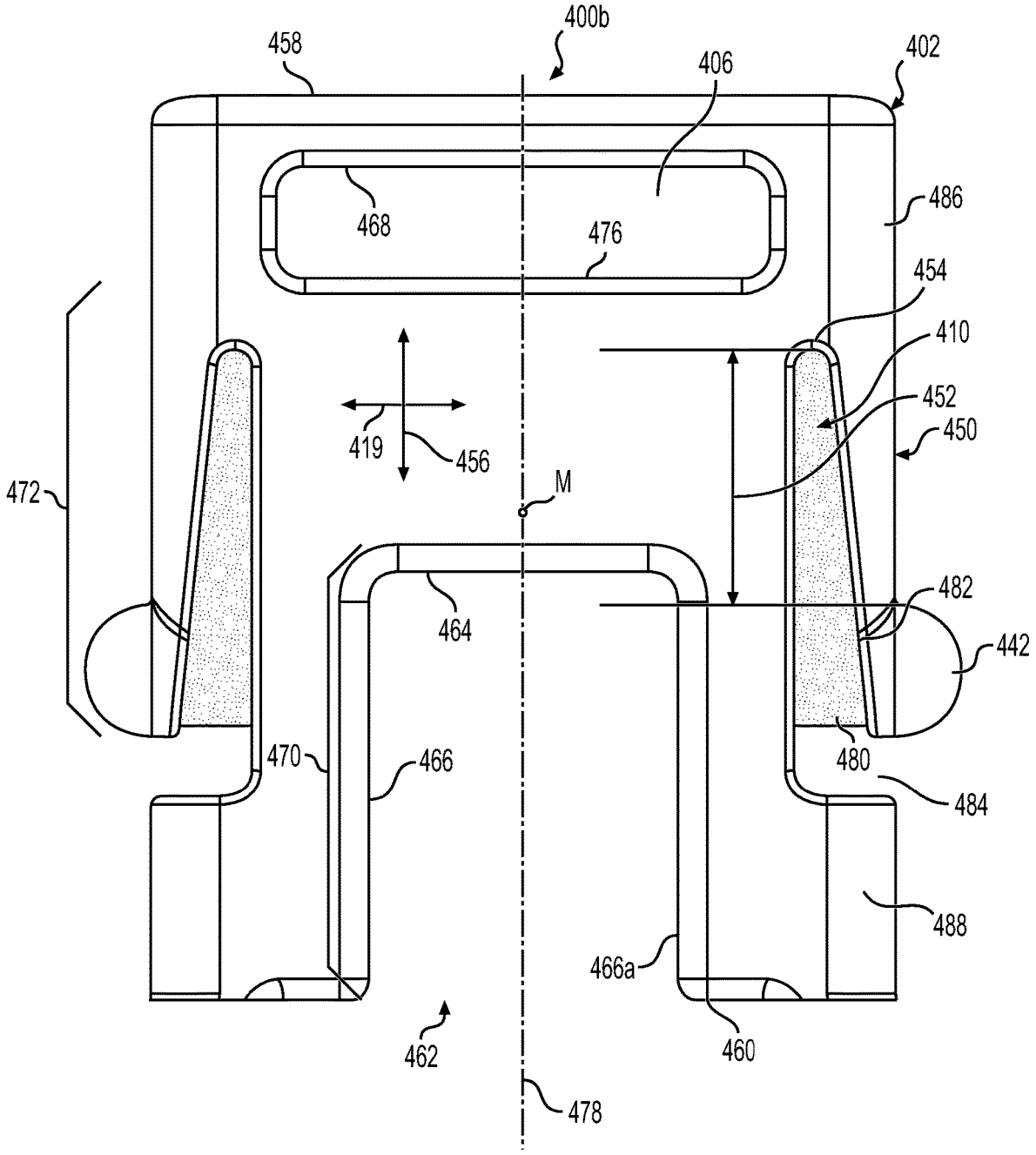
FIG. 10 is a top view of another spring clip similarly or identically configured to those of FIGS. 8 and 9, except that a cam portion (if the spring clip is intended to be inserted from the front), or a stop portion (if the spring clip is intended to be inserted from the back) at the free end of the spring clip is omitted.

However, this may not be the case so this cam portion may actually act as a stop portion when the spring clip is inserted into the aperture from the rear. In such a case, the user can continue to slide the spring clip toward the front of the adapter board, overcoming the spring force of the spring arms until the larger portion of the stepped groove is adjacent the bore and the spring arms are compressed in the aperture. This arrangement allows the insertion of a tool bit until its shank is ready to receive the spring clip. Then, the user can slide the spring clip rearwardly until the spring arms pass out of the rear of the aperture, and the spring clip engages the T-slot of the tool bit, locking it into place. In other embodiments, this stop or cam may be omitted as shown in FIG. 10, allowing the spring clip to be inserted from the front or rear of the adapter board.

Still referring to FIG. 9, a retaining spring clip 400, 400*a* may comprise an elongated body defining a longitudinal direction 416, a lateral direction 418 that is perpendicular to the longitudinal direction 416, and a transverse direction 419 that is perpendicular to the lateral direction and the longitudinal direction. A handle 402 may be disposed proximate to a first longitudinal end 420, an intermediate spring (e.g., see 404, 404*a*) may be disposed along the longitudinal direction 416, and a stepped groove 422 may be disposed proximate to a second longitudinal end 424.

As seen in FIG. 8, the elongated body may define a longitudinal length 430, a lateral width 432 that is less than the longitudinal length 430, and a transverse height 434 (see FIG. 5) that is less that the lateral width 432. The elongated body may also define a plane of symmetry 435 that includes the longitudinal direction 416, and the transverse direction 419 as shown in FIG. 9. This may not be the case for other embodiments of the present disclosure. Another plane of symmetry may be provided that is perpendicular to the transverse direction. As a result, the spring clip may be rotated 180 degrees about the longitudinal direction and still work the same. This may not be the case for other embodiments of the present disclosure.

In FIG. 9, a triangular shaped void (e.g., see 410, 410*a*) may form the backside of the intermediate spring, and a void filler 426, 426*a* may be disposed in the triangular shaped void. More specifically, the void filler may contact all three planar surfaces 428, 428*a*, and 428*b*, but not necessarily so. For example, the bottom planar surface 428*b* may be open to allow freer flexing of the spring arm. Other shapes are possible in other embodiments of the present disclosure. The void filler 426, 426*a* may comprise at least one of the following materials: an elastomer, a gel, a rubber, and a foam, etc.

In addition, the handle 402 may define an interior elongated aperture (e.g., see handle slot 406). As shown, this aperture may rectangularly shaped (e.g., has four flat sides). The stepped groove 422 may be formed by a pair of stepped prongs 436, 436*a* that terminate at the second longitudinal end 424. This may not be the case for other embodiments of the present disclosure such as shown FIG. 10.

The embodiment of the retaining spring clip 400*b* shown in FIG. 10 is well suited for front entry and access when inserted into the aperture 126 of the adapter board 104 of the blade assembly 100 of FIGS. 4 and 5. As already alluded to herein, the upper moldboard interfacing portion 108 may define a retaining spring clip receiving aperture 126 defining an axis of movement (may be parallel to or coincident with the horizontal direction 128 as shown in FIG. 5), and an aperture depth (may be the same as 148 in FIG. 6 since it is a thru aperture) measured along the axis of movement.

In FIG. 10, the retaining spring clip 400*b* has a spring arm or spring ear 450 terminating in a dual action cam surface 442, defining a cantilever catch length 452 measured from a flex point 454 of the spring ear 450 to the dual action cam surface 442 along the axis of movement 456. A ratio of the cantilever catch length to the aperture depth may range from 1.0 to 1.25 in some embodiments of the present disclosure. With the arrangement shown in FIG. 4, the cantilever catch length is equal to or greater than the depth of the aperture while the flex point is initially in the aperture. Consequently, the spring arm locks the spring clip in a locking position when desired relative to the tool bit, but also stays within the aperture when the spring clip is pulled back to release the tool bit.

Referring still to FIG. 10, the retaining spring clip 400*b* defines a first end 458, and a second end 460 along the axis of movement 456. The spring clip 400*b* may include a tool bit receiving slot 462 that includes an end surface 464 that is disposed nearer the first end 458 than the dual action cam surface 442. It should be noted that the cam surface may be a single action cam surface in other embodiments of the present disclosure for reasons set forth earlier herein. Also, the tool bit receiving slot 462 includes two slot side surfaces 466, 466*a* that extend from the end surface 464 along a direction that is parallel to the axis of movement 456.

Moreover, the retaining spring clip 400*b* may include a pry surface 468 that is disposed nearer the first end 458 than the end surface 464 of the tool bit receiving slot 462. As best seen in FIG. 5, the end surface 464 and the pry surface 468 are disposed in the aperture 126 of adapter board 104 when the spring clip is in a locked position, holding the tool bit in place. Also, the upper moldboard interfacing portion 108 may include an upper pry surface (may be the same as lead-in surface 129) that is disposed above the pry surface 468 of the retaining spring clip 400*b*. This may not be the case for other embodiments of the present disclosure.

Focusing on the geometry of the retaining spring clip 400*b* of FIG. 10, it may be characterized as follows. A handle 402 is disposed at the first end 458, while a tool bit engaging portion 470 is disposed at a second end 460. An adapter board engaging portion 472 may be disposed at least partially between the handle 402, and the tool bit engaging portion 470 along the axis of movement 456. As can be seen, there may be overlap between the handle and the adapter board engaging portion, and between the adapter board engaging portion, and the tool bit engaging portion along the axis of movement. However, the handle is spaced away from the tool bit engaging portion along the axis of movement (i.e. there is no overlap).

As alluded to earlier herein, the tool bit engaging portion 470 may define a U-shaped slot (may act as the tool bit receiving slot 462). Also, the adapter board engaging portion 452 includes a spring ear 450 that has a dual shaped cam surface 442 that is disposed adjacent the U-shaped slot along a direction (see transverse direction 419) that is perpendicular to the axis of movement 456. The handle 402 includes a handle slot 406 having a back surface 476 that overlaps the adapter board engaging portion 472 along the axis of movement 456. Also, the retaining spring clip 400*b* is symmetrical about a midplane 478 positioned along transverse direction 419. This may not be the case for other embodiments of the present disclosure.

The spring ear is cantilevered, being formed by a void 410 that is disposed behind the spring ear 450 adjacent a center of mass M of the spring clip along the transverse direction 419. As mentioned earlier herein, this void may be packed with material over time, interfering with the movement of the spring ear. To help prevent this, a resilient member 480 may at least partially fill the void 410. As used herein, a "resilient member" is at least partially made from a material that has a lower Young's modulus than that of the main body of the retaining spring clip that is made from spring steel, or the like. For example, the resilient member may be made from at least one of the following materials: a foam, a gel, a rubber, and an elastomer, etc.

In some embodiments, the void 410 has a triangular shape, and the resilient member 480 does not extend past a hypotenuse 482 of the triangular shape along the axis of movement 456. The void includes or is in communication with a channel 484 that extends to an exterior of the retaining spring clip along transverse direction 419, and the resilient member does extend to or into the channel 484. This may allow the spring arm to move more freely than what is shown in FIG. 9.

With continued reference to FIG. 10, the handle 402 may define a handle portion exterior surface 486, while the tool bit engaging portion 470 may define a tool bit engaging portion exterior surface 488 that is coextensive (+/−0.5 mm) with the handle portion exterior surface 486. The spring ear 450 extends past the handle portion exterior surface 486, and the tool bit engaging portion exterior surface 470 along transverse direction 419.

Various embodiments of a blade assembly and its associated components that may help reduce the problem of packing preventing the removal of tool bits from an adapter board will now be discussed.

Starting with FIG. 5, the adapter board 104 may have a lower tool bit attachment portion 112 that defines a lower horizontal thickness 148 as well as thru-hole or bore diameter D124 that is less than this thickness. More specifically, a ratio of the lower horizontal thickness 148 to the thru-hole diameter D124 may range from 1.25 to 1.75. If the bore is disposed horizontally about half way, then the wall thickness from the bore to an external surface may be sufficient to withstand any type of breakthrough, etc. This construction may also place each thru-hole of the series of thru-holes (e.g., see 124) partially underneath the upper moldboard interfacing portion 108, and/or in communication with each of the thru-apertures (e.g., see 126).

To provide a robust design, a first minimum wall thickness 150 of the lower tool bit attachment portion 112 measured from one of the series of thru-holes to the forward surface 132 may range from 10.0 millimeters (mm) to 40.0 millimeters (mm). Similarly, a second minimum wall thickness 152 of the lower tool bit attachment portion 112 measured from one of the series of thru-holes to a lower rear surface 154 of the lower tool bit attachment portion 112 may range from 10.0 mm to 40.0 mm. Since, the lower rear surface is spaced horizontally away from the rear surface of the upper moldboard interfacing portion, an L-shaped cross-section or profile 156 is formed as seen in FIG. 4. In FIG. 4, a chamfered surface 158 may extend from the lower rear surface 154 toward the top shelf surface 134. A plurality of depressions 160 may laterally straddle the series of thru-holes (e.g., see 124). More specifically, these depressions interrupt the chamfered surface 158, but not necessarily so. The chamfered surface and/or the depressions may be used as pry surfaces to aid in removing the spring clip.

As depicted in FIG. 5, each of the plurality of bushings 300 may include a cylindrical radially outer surface 302, and a tapered or conical radially inner surface 304. Other configurations are possible. For example, both the radially inner and radially outer surfaces may both be conical, or the annular wall of the bushing may not be cylindrical or conical, etc.

Also, each of the plurality of bushings 300 may include a top bushing surface 306 that is substantially flush with the top surface (e.g., see the top shelf surface 134) of the lower tool bit attachment portion 112, and a bottom bushing surface 308 that is substantially flush with the bottom surface 122 of the lower tool bit attachment portion 112. As used herein, "flush" means+/−0.5 mm.

As best seen in FIG. 5, but also slightly seen in FIG. 3, the bottom surface 122 may define a plurality of lower pry slots 130 that are in communication with the series of thru-holes (e.g., see 124). More particularly, the lower tool bit attachment portion 112 may define a forward surface 132 that is coplanar with the front surface 120 of the upper moldboard interfacing portion 108, and the plurality of lower pry slots 130 extend to the forward surface 132. This may not be the case for other embodiments of the present disclosure.

Focusing on FIG. 5, the tool bits 200 may also have a conical shank portion (e.g., conical portion 216) that matches the conical radially inner surface 304 of the plurality of bushings 300. Consequently, the tool bit may be more easily separated from the bushing due to the draft angle. In other embodiments such as FIG. 6, the geometry of the bushing may be machined directly into the lower tool bit attachment portion to provide a tapered bore (see 124*a*) to allow for the same functionality. Accordingly, an adapter board with a plurality of tapered bores may have the same conical surface dimensions as will be described later herein with respect to the bushing.

In order to retain the tool bits to the adapter board in non-rotating manner in use as seen in FIGS. 4 and 12, each of the plurality of tool bits 300, 300*a* include a cylindrical portion or partially cylindrical portion 214, and a flat 206 extending upwardly from the conical portion 216 of the shank. Other configurations are possible in other embodiments of the present disclosure.

Figure 7:
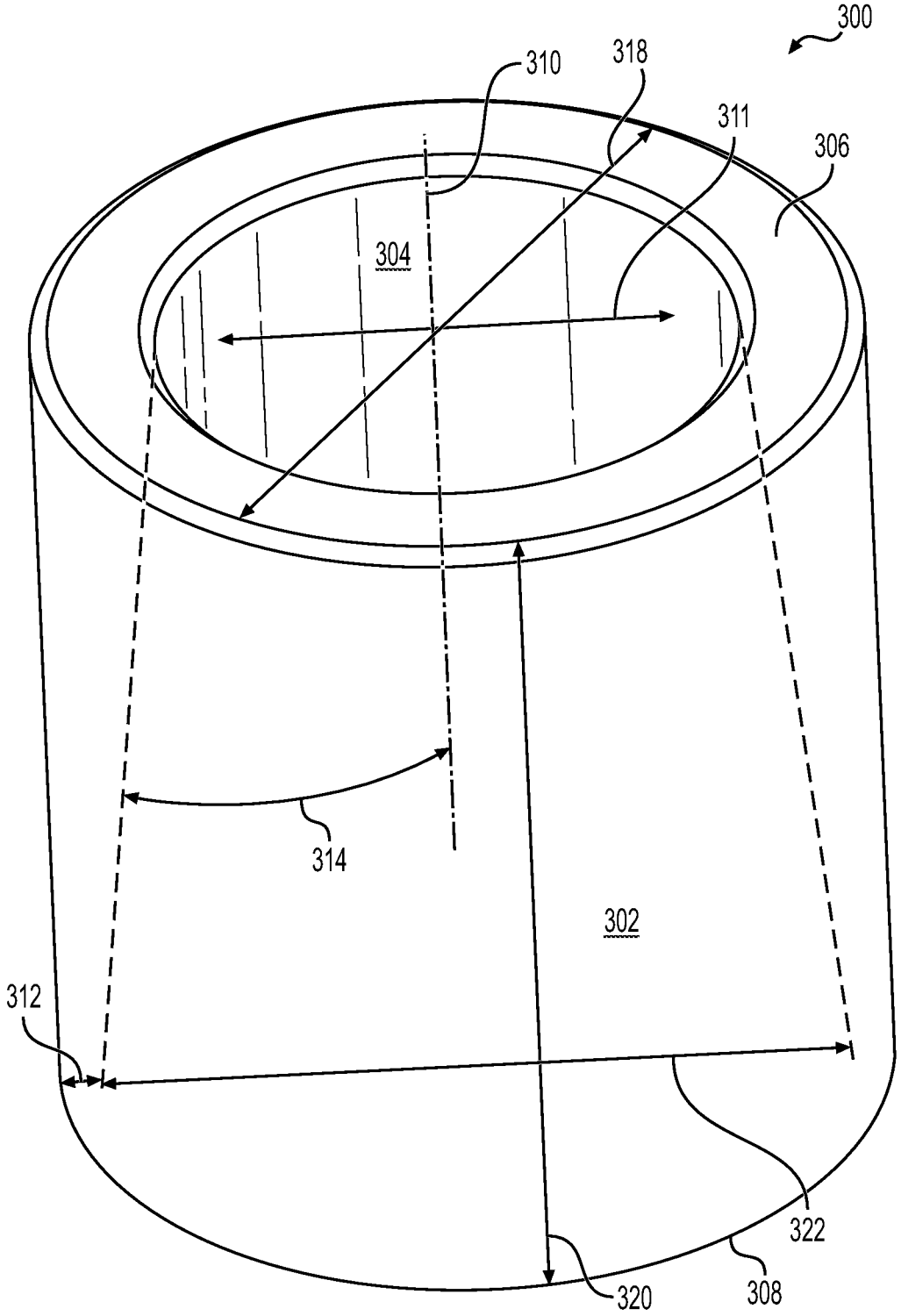
FIG. 7 is a perspective view of the tapered bushing of FIG. 5 shown in isolation.

Looking at FIG. 7, the bushing 300 may have a conical inner surface (e.g., a conical radially inner surface 304) defining a conical axis 310, and a radial direction 311, and an outer surface of revolution (e.g., a cylindrical radially outer surface 302, may be conical, etc.). To provide draft for releasing a tool bit but minimize the risk of breakthrough, the bushing 300 may define a minimum radial wall thickness 312 that ranges from 3.0 mm to 15.0 mm measured from the conical inner surface to the outer surface of revolution, and the conical inner surface defines a draft angle 314 that ranges from 2.0 degrees to 30.0 degrees in some embodiments of the present disclosure.

In order to fit and be held in the adapter board properly, as well as properly hold and then release the shank of a tool bit, the bushing may define an outer diameter 318 and an axial height 320 with a ratio of the axial height 318 to the outer diameter 318 ranging from 0.95 to 1.2 in some embodiments. Also, the tapered bushing may be made from brass or a steel material, and/or may have a wear resistant coating and/or friction reducing coating, etc. in order to provide a robust bushing and/or aid in the removal of a tool bit. Examples of such coatings include electroless nickel plating, silicon carbide plating, titanium nitride, tungsten carbide, etc.

Furthermore, the conical inner surface defines a minimum diameter 322 that ranges from 30.0 mm to 60.0 mm in some embodiments of the present disclosure. It is to be understood that the bushing may have a consistent cross-section 316 (e.g., see FIG. 5) in any plane including or defined by the radial direction 311, and the conical axis 310. This is true since the bushing may be modeled in CAD (computer aided drafting) by revolving this cross-section about the conical axis, and/or manufactured via a turning process, etc.

Various embodiments of a tool bit that may provide washout protection on its lateral or side surfaces will now be described with reference to FIGS. 11 thru 13.

In FIGS. 11 and 12, a tool bit 200*a* may comprise a working portion 208, and a shank 202 defining a shank free end 210. The working portion 208 may also include a pair of side inserts 236 (may also be referred to as "tile(s)" and may have enhanced wear or durability characteristics such as when the pair of side inserts and/or other inserts are made from a carbide material), and a front insert 238. The shank 202 also defines a surface of non-revolution 212 that may define a tangent 240 that is parallel to the front surface 242 of the front insert 238. When surface 212 is flat, then the tangent and the flat surface may be at least partially coextensive, parallel, etc. In such a case, the flat and the front insert may also extend in parallel directions. Also, the shank 202 may define a central axis 218, and the flat 206 may be parallel to the central axis 218. This may not be the case for other embodiments.

As alluded to earlier herein and best seen in FIGS. 11 and 13, the shank 202 may define a slot (204, 204*a*) that extend parallel to the pair of side inserts (that is to say the slot side surfaces 244, 244*a*) are parallel to the side surfaces 246, 246*a* of the side inserts 236, 236*a*. A middle insert 248 may be provided that is parallel to the front insert 238 (i.e., both extend substantially in the same direction, +/−2.0 degrees).

Focusing on FIGS. 11 and 13, the working portion 204 may include an upper working portion 208*a* that defines a polygonal perimeter 250 in a plane 228 that is perpendicular to the central axis 218. Also, a lower working portion 208*b* is provided that defines a plurality of pockets 250, 250*a*, 250*b*, 250*c*. The pair of side inserts 236, the front insert 238, and the middle insert 248 are disposed in the plurality of pockets. This may not be the case such as when the inserts have yet been to be attached during the manufacturing process.

Looking at FIGS. 12 and 13, the upper working portion 208*a* may include an upper front working surface 254, and the front insert 238 may include a lower front working surface (see 242) that is coplanar with the upper front working surface 254. These surfaces may be parallel to the central axis 218 as shown or not in other embodiments.

Likewise, the upper working portion 208*a* may include a rearward working surface 256 that is inclined relative to the central axis 218 as shown or not in other embodiments. Also, upper working portion 208*a* may include side working surfaces 258, 258*a* that are inclined relative to the central axis 218 as shown or not in other embodiments. As shown in FIG. 13, the side inserts 236, 236*a* include side working surfaces (see 246, 246*a*) that are parallel to the central axis 218. This may not be the case for other embodiments of the present disclosure. In general, the substrate material 272 that makes up the bulk of the tool bit including the upper working portion may back up the inserts so they are always loaded in compression in use with no overhanging geometry, helping to keep the design robust. To that end, the rear insert surfaces 260, 260*a* of the side inserts are inclined to match the inclined rearward working surface 256 of the upper working portion.

Focusing on the working portion of the tool bit before the inserts have been added, it may be described as follows focusing on FIGS. 12 and 13. As mentioned earlier herein, the shank 202 may define an axis of revolution (may be the same as the central axis 218, and may possibly be a conical axis, a cylindrical axis, etc.). Also, the working portion 208 defines a perimeter 226 in the plane 228 perpendicular to the axis that surrounds the shank 202 (at least when projected onto the plane along the central axis). This may not be the case in other embodiments of the present disclosure.

In addition, the working portion 208 may define a bottom pocket surface 262 (may be planar and perpendicular to the central axis 218, but not necessarily so) that at least partially defines a pair of side pockets 264, 264*a*, and a front pocket 265 that forms a "U shape" with the pair of side pockets 264, 264*a*. Likewise, a middle pocket 266 may form a "I shape" with the pair of side pockets 264, 264*a*. Also, the working portion may be symmetrical about a midplane 268 containing the axis of revolution. This may not be the case for other embodiments of the present disclosure.

As seen in FIG. 13, the front pocket 265 may define a front pocket width W265, and a front pocket length L265 (being substantially rectangular where the length is longer than the width), while the pair of side pockets 264, 264*a* define a side pocket width W264 (also being substantially rectangular where the length of the pocket is longer than the width) that is less than the front pocket width W265. A side pocket length L264 that is greater than the front pocket length L265. The middle pocket 266 may also define a middle pocket length L266 that is less than the front pocket length L265, and the middle pocket width W266 that is greater than the side pocket width W265 but less than the front pocket width W265. In some embodiments the middle pocket 266, the side pockets 264, 264*a*, and the front pocket 265 are formed by a plurality of planar backup surfaces 270 that are parallel to the axis of revolution or central axis 218. Inclined backup surfaces may be provided in other embodiments, etc. The various configurations of these features of the working portion may be altered in other embodiments of the present disclosure.

After fully manufactured and assembled, the tool bit may be characterized as follows while still focusing on FIG. 13.

The working portion 208 may include a pair of side inserts 236, 236*a*, a front insert 238 abutting the pair of side inserts 236, 236*a*, and a middle insert 248 abutting the pair of side inserts 236, 236*a*. The working portion 208 may include a base or substrate material 272 disposed between the front insert 238, and the middle insert 248, as well as between the side inserts 236, 236*a*. The substrate material 272 includes at least one of the following: an iron, and a steel, etc. It is to be understood due to manufacturing tolerances a slight gap may be present initially between the inserts of less than 0.2 mm. Hence, the term "abutting" includes such a slight gap.

As alluded to earlier herein, each of the pair of side inserts 236, 236*a* may include an exposed side surface 246, 246*a*, an exposed rear surface (e.g., rear insert surface 260, 260*a*), and an exposed bottom surface 276.

Similarly, the middle insert 248 (may also be referred to as a "reinforcement" insert) includes an exposed middle insert bottom surface 278. The front insert includes a pair of exposed front insert side surfaces 280, an exposed front insert bottom surface 282, and an exposed front surface 242.

As a result of this construction, the side surfaces of the inserts and the upper working portion may be coplanar so that until the side inserts are worn away, the front and sides of the working portion may wear more slowly. Once, the side inserts have been worn away, the sides of the working portion are still protected to a limited degree by the side surfaces of the middle insert, slowing down wear. Any insert or tile described herein may be made from a carbide material such as Tungsten Carbide with a binding agent (such as Cobalt). Other methods for attaching the inserts or tiles are possible.

The tool bit 200, 200*a* itself or the adapter board 104 may be forged or cast using iron, grey cast-iron, steel or any other suitable material.

Again, it should be noted that any of the dimensions, angles, surface areas and/or configurations of various features may be varied as desired or needed including those not specifically mentioned herein. Although not specifically discussed, blends such as fillets are shown in the figures to connect the various surfaces. These may be omitted in other embodiments and it is to be understood that their presence may be ignored sometimes when reading the present specification.

INDUSTRIAL APPLICABILITY

In practice, a machine, a blade assembly, a tool bit, a bushing, a wear member, an adapter board and/or spring clip may be manufactured, bought, or sold to retrofit a machine, a tool bit, a wear member or blade assembly in the field in an aftermarket context, or alternatively, may be manufactured, bought, sold or otherwise obtained in an OEM (original equipment manufacturer) context.

The tool bit, the adapter board, and/or the spring clip may be forged or cast using iron, grey cast-iron, steel, spring steel, or any other suitable material. Any of these components may be manufactured as a unitary component, or as an integral subassembly, etc. After forging or casting, the various components may be machined to final desired dimensions as needed. The bushing may be made for tube stock that is turned on a lathe or the like to its final desired dimensions, etc.

One or more bushings may be suppled within the adapter board as originally supplied or as a replacement part. If a bit (or other wear member) were to get seized within the bit shank hole, then both the bit and the bushing can be pressed out and a new bushing can be pressed back in. The bushing may also help with the adapter board's end of life. Instead of scrapping the adapter board, bushings can be replaced to rebuild the adapter board. The bushing may be made of any suitable material including steel, etc., and may be later coated for lubricity, wear prevention, etc. In other embodiments, the bushing geometry may be incorporated directly into the adapter board.

Various embodiments of the present disclosure as previously discussed herein may relate to a system including an anti-rotation design for bits that fits into an adapter board. In previous designs, the anti-rotation design includes machined slots in the bottom of the adapter board and the bits that fit therein. The anti-rotation design is in a wear zone and may be worn out earlier than any other part of the system. So, the present disclosure pertains to a bit with an anti-rotation feature that is remove from a wear zone. The anti-rotation has been relocated to the top of the bit and toward the back of an adapter board, protecting the anti-rotation feature from wear. The bits are disposed in the adapter board in such a way that the back of the adapter board and the top of the bits are used for anti-rotation. Further, the solution uses only the top portion of the shank of the bit.

Other embodiments of the present disclosure relate to a design for a bit used by a blade assemble of a motor grader or the like. In previous designs, the bit is preferably facing in direction of travel to of the motor grader to prevent washout of support steel. As a result, the present disclosure pertains to a new bit design that includes two layers of carbide for extended wear life. The new design further includes two carbide tiles on the side of a bit. The two side tiles on the bit prevent wear on support steel that supports the back of the bit and may prevent early damage.

Yet further embodiments of the present disclosure relate to the packing of a lock. Currently, the lock has a plurality of voids that are prone to be packed with the material will that may prevent the lock from being removed. Consequently, the present disclosure pertains to a new lock that uses foam or rubber to fill in the void of a lock. The foam or rubber may act as a spring force or just act as a filler. The foam or rubber may prevent the material from packing inside the lock, so that the lock can be removed more reliably and easier.

In still further embodiments of the present disclosure, the lock or spring clip and associated adaptor board are made so that installation and removal of the spring clip are eased. In previous designs, the clip is small and difficult to install. Further, the clip receiving groove can be packed with material that may prevent a proper seat that could cause bit loss. To address this problem, the present disclosure pertains to a bit retention method for a mining bit system that utilizes a U-shaped clip inserted from the front of an adapter board. The clip engages the top of the bit to prevent it from moving in its only direction of freedom (e.g., the vertical direction). The U-clip is inserted through a slot in the adapter board and engages a T-slot on the top of the bit. The U-clip may have two spring steel ears on the side that hold it in a locked position and prevent the clip from unlocking. Further, a pry bar may be used to pull the U-slot through the adapter board to remove the bit, etc.

In yet other embodiments, the present disclosure relates to a cylindrical bore that is used for removal of a bit. In previous designs, an adapter board has a machined cylindrical bore into which the bit fits. Sometimes, the work material may get packed within the cylindrical bore and may require up to 50 tons of force to remove the bit. To help remedy this problem, the present disclosure discloses an adapter board with a tapered bushing for easier removal of the bit without necessarily complicating the manufacture of the adapter board. The taper in the bushing and on the bit may make it easier for removing the bit with material packed in the joints or seams of the adapter board, bushing, etc. The bushing is also replaceable and may be alleviate the need for replacing the entire adapter board.

The spring clips disclosed herein may allow a method of attaching or detaching a tool bit. The method may include moving or sliding a spring clip so that it is movably attached to an adapter board. The spring clip may be moved to an unlocked position, while still being movably attached to the adapter board. Now, a tool bit may be attached to the adapter board in a non-rotating manner. Next, the spring clip may be moved to a locked position, keeping the tool bit fixed to the adapter board in a non-rotating manner.

To remove the tool bit, one or more of these steps may be reversed. If the spring clip is needed to be repaired, replaced, etc., then the spring clip may be removed using a maneuver that is opposite that used to attach the spring clip to the adapter board.

The steps of moving the spring clip to an unlocked position, may involve sliding the spring clip until a stop surface of the spring clip contacts the adapter board, and/or until a spring arm is disposed in the aperture of the adapter board. Complete removal of the spring clip may include continuing to slide the spring clip until the spring arm is no longer disposed in the aperture of the adapter board.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A blade assembly comprising:

an adapter board including an upper moldboard interfacing portion include a rear surface, a front surface, and a series of thru-apertures extending from the front surface to the rear surface; and a lower tool bit attachment portion, terminating in a lower adapter board free end with a bottom surface, and including a top surface disposed adjacent the rear surface of the upper moldboard interfacing portion, also defining a series of thru-holes extending from the top surface to the bottom surface, each thru-hole of the series of thru-holes being in communication with each of the series of thru-apertures;

wherein the adapter board defines a lateral direction, a vertical direction that is perpendicular to the lateral direction, and a horizontal direction that is perpendicular to the vertical direction, and the lateral direction, each of the series thru-holes defines a thru-hole diameter, the lower tool bit attachment portion defines a lower horizontal thickness, and a ratio of the lower horizontal thickness to the thru-hole diameter ranges from 1.25 to 1.75.

2. The blade assembly of claim 1, further comprising a plurality of bushings wherein one of the plurality of bushings is disposed in one of the series of thru-holes.

3. The blade assembly of claim 2, wherein each of the plurality of bushings includes a cylindrical outer surface, and a conical inner surface.

4. The blade assembly of claim 2, wherein each of the plurality of bushings includes a top bushing surface that is substantially flush with the top surface of the lower tool bit attachment portion, and a bottom bushing surface that is substantially flush with the bottom surface of the lower tool bit attachment portion.

5. The blade assembly of claim 1, wherein the bottom surface defines a plurality of lower pry slots that are in communication with the series of thru-holes.

6. The blade assembly of claim 5, wherein the lower tool bit attachment portion defines a forward surface that is coplanar with the front surface of the upper moldboard interfacing portion, and the plurality of lower pry slots extend to the forward surface.

7. The blade assembly of claim 6, wherein a first minimum wall thickness of the lower tool bit attachment portion measured from one of the series of thru-holes to the forward surface ranges from 10.0 mm to 40.0 mm.

8. The blade assembly of claim 7, wherein a second minimum wall thickness of the lower tool bit attachment portion measured from one of the series of thru-holes to a lower rear surface of the lower tool bit attachment portion ranges from 10.0 mm to 40.0 mm.

9. The blade assembly of claim 3, further comprising a plurality of tool bits having a conical shank portion that matches the conical inner surface of the plurality of bushings.

10. The blade assembly of claim 9, wherein each of the plurality of tool bits includes a cylindrical portion, and a flat portion extending upwardly from the conical shank portion.

11. An adapter board comprising:

an upper moldboard interfacing portion include a rear surface, a front surface, and a series of thru-apertures extending from the front surface to the rear surface; and a lower tool bit attachment portion, terminating in a lower adapter board free end with a bottom surface, and including a top surface disposed adjacent the rear surface of the upper moldboard interfacing portion, also defining a series of thru-holes extending from the top surface to the bottom surface, each thru-hole of the series of thru-holes being in communication with each of the series of thru-apertures;

wherein the adapter board defines a lateral direction, a vertical direction that is perpendicular to the lateral direction, and a horizontal direction that is perpendicular to the vertical direction, and the lateral direction, each of the series of thru-holes defines a thru-hole diameter, the lower tool bit attachment portion defines a lower horizontal thickness, and each thru-hole of the series of thru-holes is disposed horizontally partially underneath the upper moldboard interfacing portion.

12. The adapter board of claim 11, wherein a ratio of the lower horizontal thickness to the thru-hole diameter ranges from 1.25 to 1.75, and the bottom surface defines a plurality of lower pry slots that are in communication with the series of thru-holes.

13. The adapter board of claim 12, wherein the lower tool bit attachment portion includes a lower rear surface spaced horizontally away from the rear surface of the upper moldboard interfacing portion, forming an L-shaped cross-section of the adapter board, and further including a chamfered surface extending from the lower rear surface toward the top surface.

14. The adapter board of claim 13, wherein the lower tool bit attachment portion includes a plurality of depressions laterally straddling the series of thru-holes.

* * * * *